US008662917B2

(12) United States Patent
Wang et al.

(10) Patent No.: US 8,662,917 B2
(45) Date of Patent: Mar. 4, 2014

(54) CABLE ASSEMBLY HAVING AN IMPROVED CIRCUIT BOARD

(75) Inventors: Chien-Chiung Wang, New Taipei (TW); Xue-Liang Zhang, Kunshan (CN); Qing-Man Zhu, Kunshan (CN); Jian-Jun Zhu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 23 days.

(21) Appl. No.: 13/314,468

(22) Filed: Dec. 8, 2011

(65) Prior Publication Data

US 2012/0149255 A1 Jun. 14, 2012

(51) Int. Cl.
*H01R 12/24* (2006.01)

(52) U.S. Cl.
USPC ..... 439/497; 439/493; 439/951

(58) Field of Classification Search
USPC ..... 439/725, 607.41, 607.46, 947, 497, 439/493, 951
See application file for complete search history.

(56) References Cited

U.S. PATENT DOCUMENTS 4,496,094 A * 1/1985 Allen ..... 228/56.1
4,993,968 A * 2/1991 Guletsky et al. ..... 439/492
6,007,347 A * 12/1999 Keldsen et al. ..... 439/63
6,661,318 B2 * 12/2003 Tamaki et al. ..... 333/260
6,857,898 B2 * 2/2005 Engquist et al. ..... 439/493
6,880,241 B2 * 4/2005 Edwardsen et al. ..... 29/828
6,927,655 B2 * 8/2005 Torigoe et al. ..... 333/260
7,112,067 B1 * 9/2006 Korsunsky et al. ..... 439/65
7,269,896 B2 * 9/2007 Edwardsen et al. ..... 29/828
7,275,953 B2 * 10/2007 Brown et al. ..... 439/493
7,278,855 B2 * 10/2007 Yasumura et al. ..... 439/65
7,297,028 B2 * 11/2007 Daikuhara et al. ..... 439/607.46
7,637,779 B2 * 12/2009 Nagata et al. ..... 439/607.49
7,651,336 B2 * 1/2010 Yasumura et al. ..... 439/65
2006/0121794 A1 * 6/2006 Hanley et al. ..... 439/677
2012/0129396 A1 * 5/2012 Wang et al. ..... 439/607.01

* cited by examiner

*Primary Examiner* — Tho D Ta
*Assistant Examiner* — Travis Chambers
(74) *Attorney, Agent, or Firm* — Ming Chieh Chang; Wei Te Chung

(57) ABSTRACT

A cable assembly (100) includes a cover (40) defining a cavity (101), a circuit board (20) assembled in the cavity and including a first surface (201) and a second surface (202) lower than the first surface, and a cable (2) having a jacket (22) and a number of wires (21) shrouded by the jacket. Each wire includes an inner coat (210) and a conductor having a free end (211) exposed outwardly from the inner coat for being soldered to the first surface, with the inner coat disposed on the second surface.

12 Claims, 6 Drawing Sheets

CABLE ASSEMBLY HAVING AN IMPROVED CIRCUIT BOARD

BACKGROUND OF THE INVENTION

1. Field of the Invention

The present invention relates to a cable assembly, and more particularly to a SFP (Small Form-factor Pluggable) cable assembly having a circuit board mounted therein.

2. Description of Related Art

U.S. Pat. No. 7,297,028, issued to Daikuhara on Nov. 20, 2007 discloses a cable connector having a PCB (Printed Circuit Board). A cable has a number of wires soldered to the PCB via a number of soldering joints for transmitting high speed signals. The PCB has a flat top surface and a number of soldering pads formed thereon. Each of the wires includes a conductor and a coat wrapped on the conductor. A front end of the conductor is exposed outwardly from the coat and is bent close to the soldering pad when the conductor is soldered to the PCB. It is hard to solder the conductors to the flat top surface due to a thickness of the coat.

Hence, a cable assembly having an improved circuit board is desired.

SUMMARY OF THE INVENTION

Accordingly, an object of the present invention is to provide a cable assembly having an improved internal circuit board. The cable assembly includes a cover defining a cavity, a circuit board assembled in the cavity having a first surface and a second surface lower than the first surface. The cable assembly further has a cable including a jacket and a number of wires shrouded by the jacket. Each wire includes a inner coat and a conductor having a free end exposed outwardly from the inner coat. The free end of the conductor is soldered to the first surface, and the inner coat is disposed on the second surface. The height between the first surface and the second surface is substantially equal to a thickness of the inner coat. Thus, the free end of the conductor could extend straightly from the inner coat, and is convenient to be soldered on the top surface.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
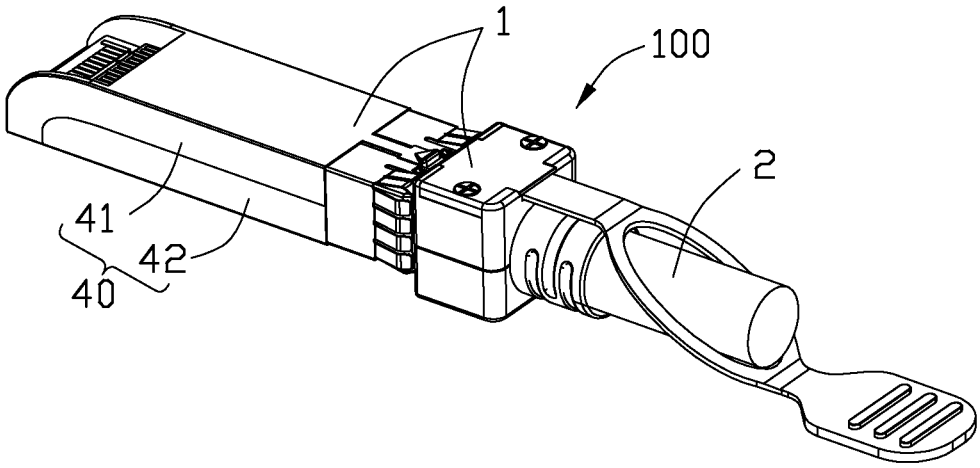
FIG. 1 is an assembled perspective view showing a cable assembly in accordance with the present invention.

Referring to FIG. 1, a cable assembly 100 comprises a connector module 1 adapted for mating with a receptacle connector (not shown) and a cable 2 connecting to the connector module 1.

Figure 2:
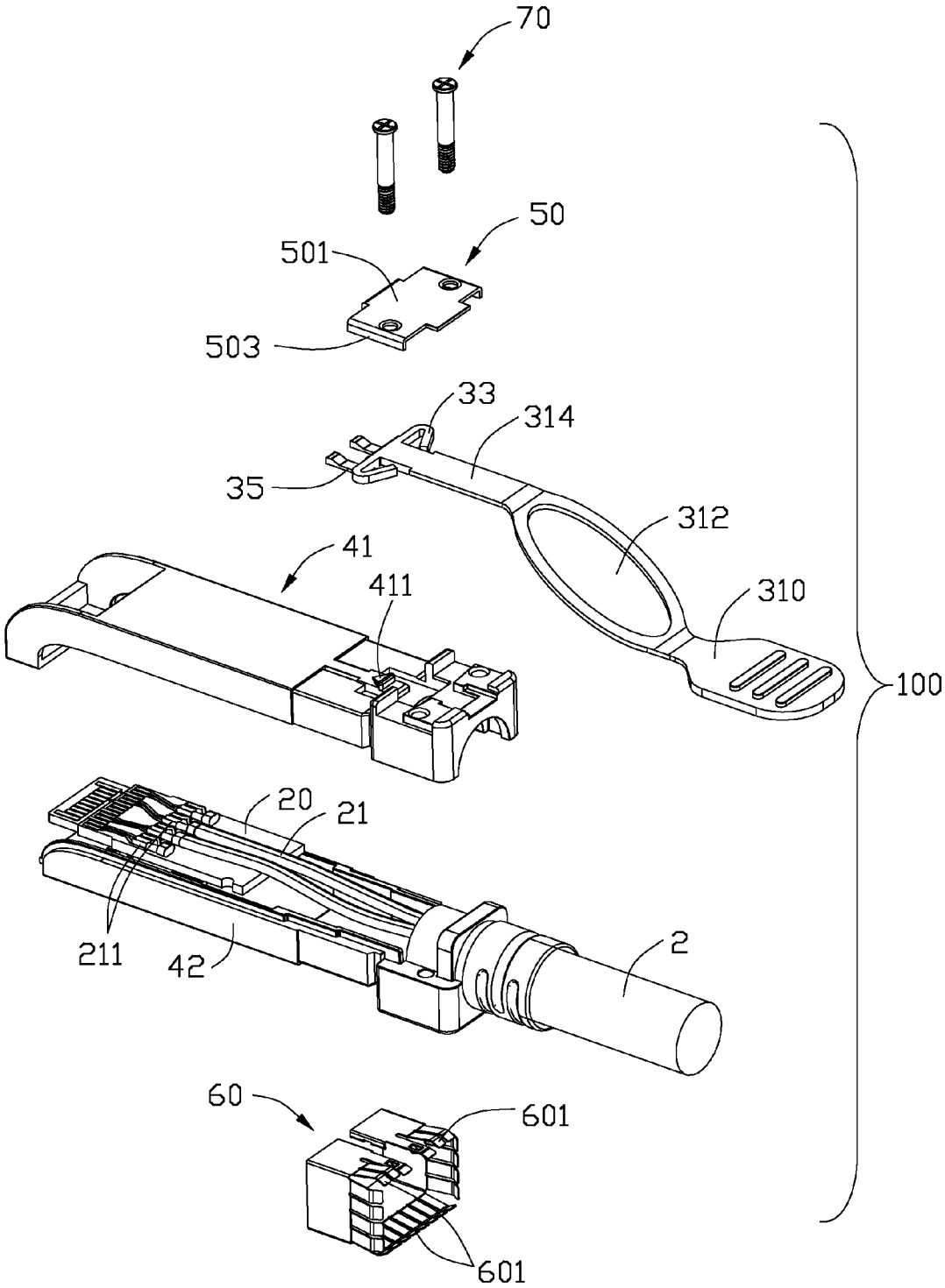
FIG. 2 is a partially exploded perspective view showing the cable assembly as shown in FIG. 1.
Figure 3:
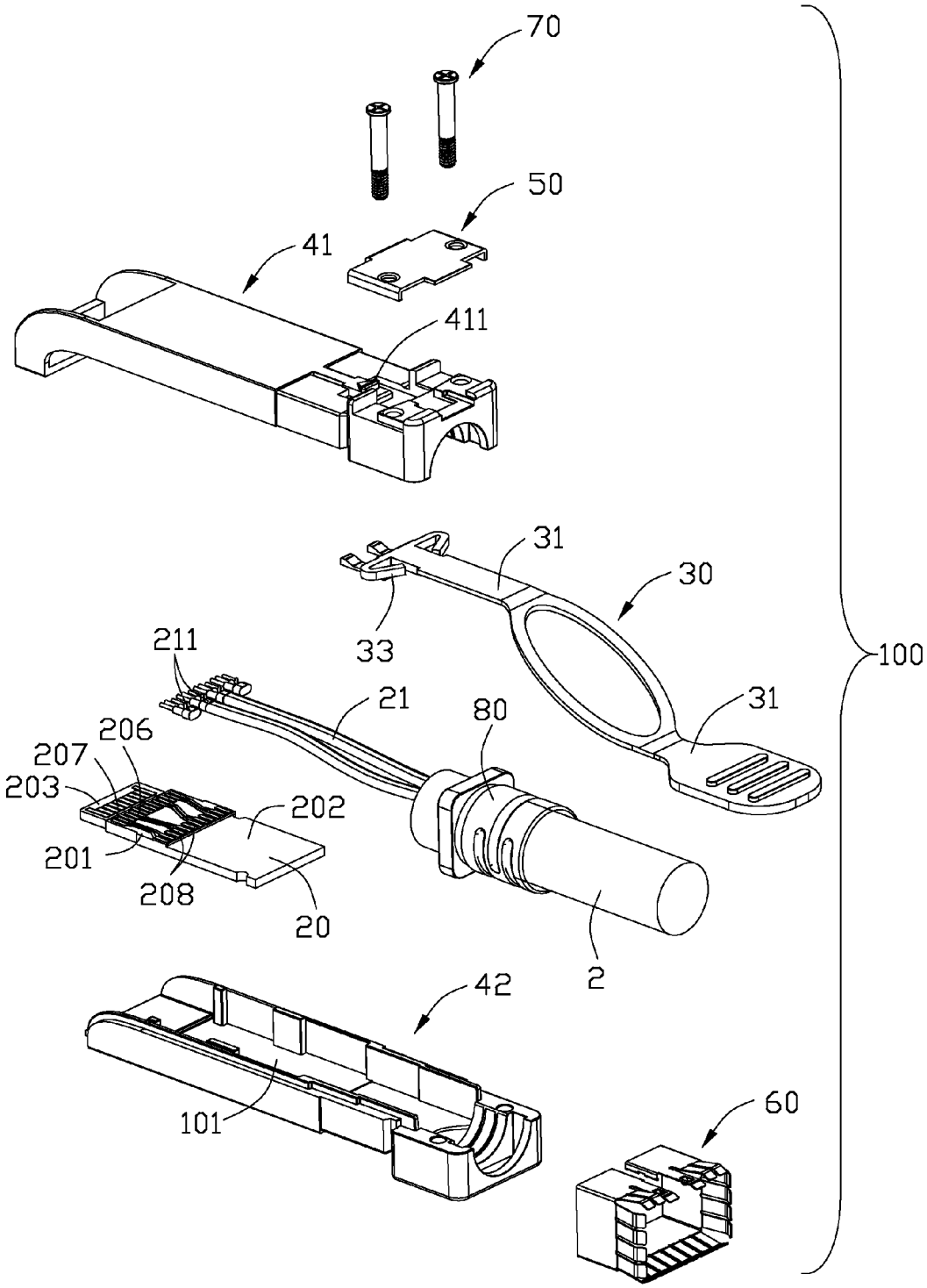
FIG. 3 is an exploded perspective view showing the cable assembly as shown in FIG. 2.

Referring to FIGS. 2 and 3, the connector module 1 comprises a cover 40 and a circuit board 20 assembled therein. The cover 40 includes a top cover 41, a bottom cover 42 and a cavity 101 formed therebetween. The top cover has a protrusion 411 for locking with the receptacle connector. The connector module 1 further includes a releasing mechanism 30 movable from a latched position to a released position for releasing the protrusion 411.

The releasing mechanism 30 includes a connection portion 314, an actuating portion 35 formed at the front of the connection portion 314 and an operating portion 310 formed at the end of the connection portion 314 for actuating the releasing mechanism 30. The connection portion 314 includes a circle holding portion 312 adjacent to the operating portion 310. The cable 2 is mounted through the circle holding portion 312 for holding the releasing mechanism 30. The connection portion 314 further includes an elastic portion 33 adjacent to the actuating portion 35 for actuating the releasing mechanism 30 from the released position to the latched position. The connector mold 1 further includes a shielding blade 50 having two screw holes 503 for mounting screws 70 to the top cover 41. The shielding blade 50 and the screws 70 assemble the releasing mechanism 30 to the top cover 41. The connector module 1 has a shield clip 60 clipping around the rear portion of the cover 40. The shield clip 60 has a number of elastic blades 601 for contacting the receptacle connector.

Figure 4:
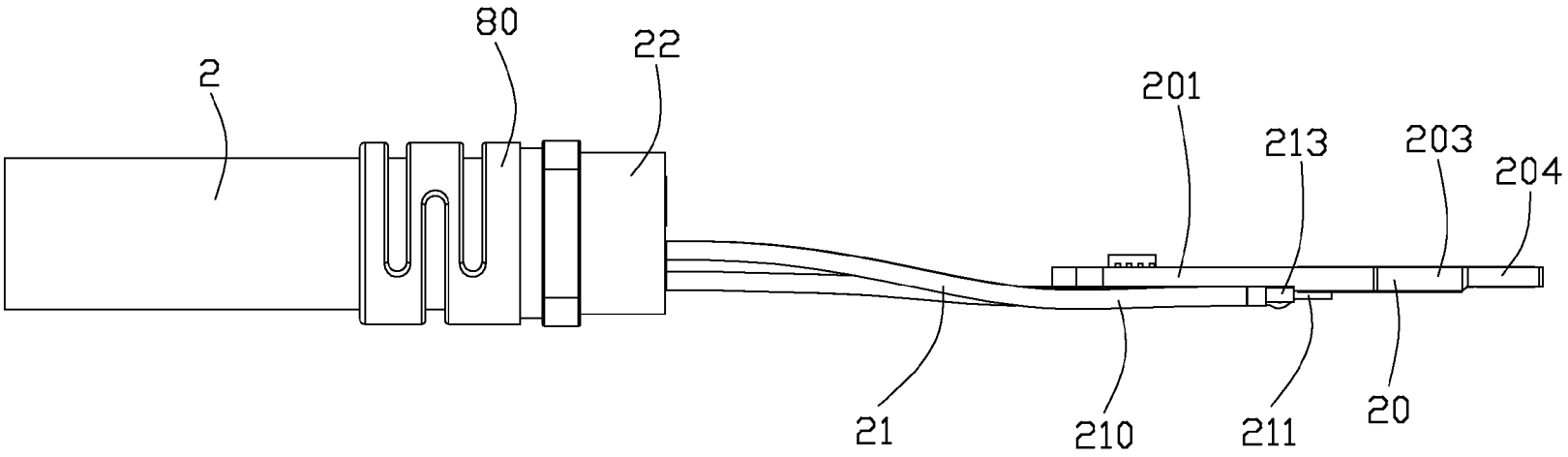
FIG. 4 is a side view showing the cable soldered to the circuit board.
Figure 5:
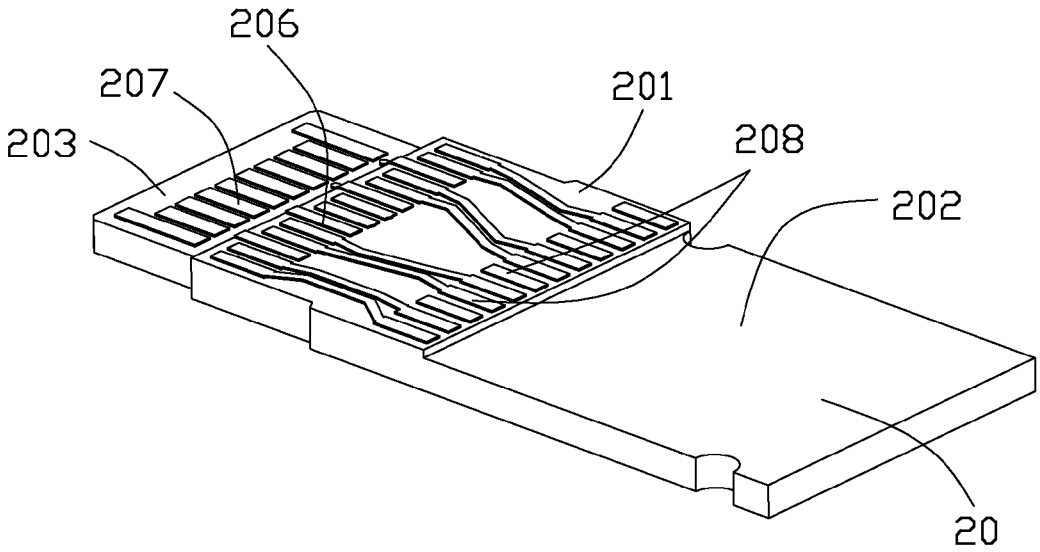
FIG. 5 is an enlarged perspective view showing the circuit board in accordance with a first embodiment of the present invention.

Referring to FIGS. 4 and 5, the circuit board 20 is assembled in the cavity 101 and connected with a cable 2. The cable 2 has a jacket 22 and a number of wires 21 shrouded in the jacket 22. Each wire 21 includes an inner coat 210 and a conductor having a free end 211 exposed from the inner coat 210. The cable 2 further has a boot 80 molded on the jacket 22. The boot 80 is fixed by the top cover 41 and bottom cover 42 for assembling the connector module 1 to the cable 2.

The circuit board 20 includes a first surface 201, a second surface 202 behind the first surface 201 and lower than the first surface 201, and a third surface 203 positioned at the front of the first surface 201. The circuit board 20 has a number of soldering pads 208 formed at a behind edge of the first surface 201 for respectively soldering the free ends 211. The inner coat 210 is disposed on the second surface 202. The height between the first surface 201 and the second surface 202 is substantially equal to a thickness of the inner coat 210. Thus, the free end 211 of the conductor could extend straightly from the inner coat 210, and is convenient to be soldered to the circuit board 20.

The circuit board 20 includes a number of mating pads 206 formed at the front edge of the first surface 201 and a number of mating pads 207 formed at the front edge of the third surface 203 for mating with the receptacle connector. Both the second surface 202 and the third surface 203 are defined lower than the first surface 201. In order to be manufactured conveniently, the second surface 202 is always flush with the third surface 203.

In this embodiment, a first board having the second surface 202 and the third surface 203 flushed with the second surface 202 is provided firstly. A second board having the first surface 201 is attached onto the first board to form the circuit board 20. Therefore, the first surface 201 is higher than the second surface 202 and the third surface 203. Optionally, the second surface 202 and the third surface 203 could be not flush with each other in another embodiment.

Figure 6:
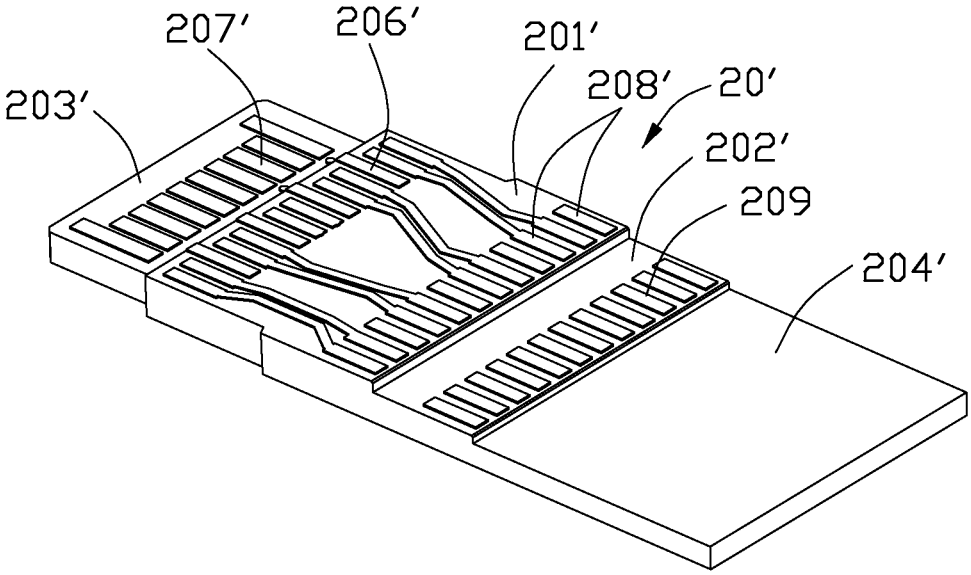
FIG. 6 is a perspective view showing the circuit board in a second embodiment.

FIG. 6 shows a second embodiment of the inner circuit board 20'. The circuit board 20' includes a first surface 201', a second surface 202' behind the first surface 201' and lower than the first surface 201', a third surface 203' positioned in front of the first surface 201', and a fourth surface 204' positioned behind the second surface 202'. The circuit board 20' has a number of soldering pads 208' formed at a rear edge of the first surface 201', and a number of soldering pads 209 formed at a rear edge of the fourth surface 204' for respectively being soldered with the free ends 211. A first group of the wires 21 are selectively soldered to the first surface 201' with the inner coats 210 disposed on the second surface 202'. A second group of the wires 21 are soldered to the second surface 202' with the inner coats 210 accordingly disposed on the fourth surface 204'. The height between the first surface 201' and the second surface 202', and the height between the second surface 202' and the fourth surface 204' are substantially equal to the thickness of the inner coat 210. Thus, the free end 211 of the conductor could extend straightly from the inner coat 210, and is convenient to be soldered to the soldering pads 208' and the soldering pads 209.

The circuit board 20' includes a number of mating pads 206' formed at the front edge of the first surface 201' and a number of mating pads 207' formed at the front edge of the third surface 203' for mating with the receptacle connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a cover defining a cavity;

a circuit board being assembled in said cavity and having on one side thereof a first surface, a second surface behind and lower than the first surface, and a third surface in front of and lower than the first surface, said third surface having a set of mating pads for mating with a receptacle connector; and a cable having a jacket and a plurality of wires shrouded by the jacket, each wire including an inner coat disposed on the second surface and a conductor having a free end exposed outwardly from the inner coat and soldered to the first surface; wherein the circuit board has another set of mating pads formed at a front edge of the first surface for mating with the receptacle connector and a plurality of soldering pads formed at a rear edge of the first surface for soldering the free ends of the conductors.

2. The cable assembly as claimed in claim 1, wherein a height between the first surface and the second surface is substantially equal to a thickness of the inner coat.

3. The cable assembly as claimed in claim 1, wherein the third surface is flush with the second surface.

4. The cable assembly as claimed in claim 1, wherein the circuit board further includes a fourth surface behind and lower than the second surface.

5. The cable assembly as claimed in claim 1, further including a boot molded on the jacket of the cable and assembled to the cover.

6. A cable connector assembly comprising:

a case defining opposite front and rear ends with a receiving space therebetween, a printed circuit board disposed in the receiving space and defining thereof a set of pads located at a region which is not adjacent to a rear end of the printed circuit board;

a cable including a plurality of wires and extending out of the casing around said rear end, each of said wires including an inner conductor surrounded in an outer insulator under condition that a front end section of the inner conductor extends forwardly beyond a front end section of the insulator; wherein the printed circuit board defines a first downward step structure proximal and behind the pads so as to form a recess to accommodate the front end section of the insulator for allowing the front end section of the inner conductor to be easily soldered upon the corresponding pad; wherein the printed circuit board defines another set of pads in front of the set of pads and exposed around the front end of the case for mating with a complementary connector; and wherein a second downward step structure is formed in a front end section of the printed circuit board, and said another set of pads are located on the second downward step structure.

7. The cable connector assembly as claimed in claim 6, wherein the front end section of the printed circuit board is narrower, in a transverse direction, than remaining portions of the printed circuit board.

8. The cable connector assembly as claimed in claim 6, wherein a distance is defined between the case and the first downward step structure, which is large enough to loosely receive the insulator without deformation.

9. The cable connector assembly as claimed in claim 6, wherein another set of pads are formed on the first downward step structure, and another downward step structure is formed proximal and behind the first downward step structure.

10. A cable connector assembly comprising:

a case defining a receiving space;

a printed circuit board disposed in the receiving space and defining opposite front and rear ends thereof in a front-to-back direction under condition that the printed circuit board defines a front thicker segment, and a rear thinner segment with an interface step therebetween;

a plurality of pads formed on the thicker segment adjacent to the interface step; and a cable including a set of wires, each of said wires defining an inner conductor surrounded by an outer insulator; wherein the inner conductor is soldered unto the corresponding pad on the thicker segment while the outer insulator confronts the thinner segment in a somewhat compensation manner so as not to have the whole wire deformed too much;

the printed circuit board further defines another thinner segment in front of the thicker segment with another set of pads thereon for mating with a complementary connector; and said another thinner segment is narrower, in a transverse direction, than the thicker segment and the thinner segment.

11. The cable connector assembly as claimed in claim 10, wherein the interface step is essentially in a vertical manner.

12. The cable connector assembly as claimed in claim 10, further including another thinner segment behind the thinner segment with another set of pads on said thinner segment to couple to another set of wires smoothly.

* * * * *